US011247465B2

(12) United States Patent
Sugiura

(10) Patent No.: US 11,247,465 B2
(45) Date of Patent: Feb. 15, 2022

(54) LIQUID DISCHARGING APPARATUS

(71) Applicant: BROTHER KOGYO KABUSHIKI KAISHA, Nagoya (JP)

(72) Inventor: Keita Sugiura, Toyokawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/032,298

(22) Filed: Sep. 25, 2020

(65) Prior Publication Data

US 2021/0138788 A1 May 13, 2021

(30) Foreign Application Priority Data

Nov. 12, 2019 (JP) ..... JP2019-204421

(51) Int. Cl.
*B41J 2/14* (2006.01)
*B41J 2/16* (2006.01)

(52) U.S. Cl.
CPC ..... *B41J 2/14201* (2013.01); *B41J 2/1433* (2013.01); *B41J 2/1612* (2013.01)

(58) Field of Classification Search
CPC .... B41J 2/14201; B41J 2/1612; B41J 2/1433; B41J 2/14233; B41J 2202/12; B41J 2002/14419
See application file for complete search history.

(56) References Cited

FOREIGN PATENT DOCUMENTS

JP 2017-77643 A 4/2017
JP 2017077643 A * 4/2017

OTHER PUBLICATIONS

IP.com search (Year: 2021).*

* cited by examiner

*Primary Examiner* — Lisa Solomon
(74) *Attorney, Agent, or Firm* — Merchant & Gould P.C.

(57) ABSTRACT

A liquid discharging apparatus includes: a nozzle surface having a nozzle; a pressure chamber communicating with the nozzle and configured to store liquid; a piezoelectric body configured to apply pressure to the liquid inside the pressure chamber; a supply manifold configured to supply the liquid to the pressure chamber; a return manifold arranged to overlap with the supply manifold and configured to allow the liquid, which is not discharged from the nozzle, to flow therethrough; a pair of elastically deformable portions provided between the supply manifold and the return manifold; a damper space formed between the elastically deformable portions; and a shielding plate configured to separate the damper space into a first damper space and a second damper space, wherein Young's modulus of the shielding plate is greater than Young's modulus of each of the elastically deformable portions.

6 Claims, 5 Drawing Sheets

LIQUID DISCHARGING APPARATUS

CROSS REFERENCE TO RELATED APPLICATION

The present application claims priority from Japanese Patent Application No. 2019-204421, filed on Nov. 12, 2019, the disclosure of which is incorporated herein by reference in its entirety.

BACKGROUND

Field of the Invention

The present disclosure relates to a liquid discharging apparatus which discharges liquid such as ink, etc.

Description of the Related Art

There is a known liquid discharging apparatus which is provided with a configuration as described in Japanese Patent Application Laid-open No. 2017-077643 and which discharges liquid such as ink, etc. The above-described liquid discharging apparatus is provided with a supply manifold (supplying channel) configured to supply the liquid to a plurality of pressure chambers and a return manifold (circulating channel) which communicates with the plurality of pressure chambers and to which a part of the liquid is returned. Further, elastically deformable portions (thin film portions) and a space part between the elastically deformable portions are formed at a part, of the liquid discharging head, which faces both of the supply manifold and the return manifold.

Further, the above-described liquid discharging apparatus is provided with a shielding plate (partitioning channel plate) which separates the space part into a first space part and a second space part. Accordingly, the elastic deformation of one of the elastically deformable portions is less likely to affect the other of the elastically deformable portions.

SUMMARY

In Japanese Patent Application Laid-open No. 2017-077643, however, the shielding plate is not sufficiently considered. Due to this, depending on the difference in the property between the material constructing the shielding plate and the material constructing the elastically deformable portions, there is such a possibility that the elastic deformation of one of the elastically deformable portions might affect the other of the elastically deformable portions, even in the configuration provided with the shielding plate.

In view of the above situation, an object of the present disclosure is to provide a liquid discharging apparatus capable of preventing the elastic deformation of one of the elastically deformable portions from affecting the other of the elastically deformable portions.

According to an aspect of the present disclosure, there is provided a liquid discharging apparatus including: a nozzle surface in which a nozzle is formed; a pressure chamber communicating with the nozzle and configured to store liquid; a piezoelectric body configured to apply pressure to the liquid inside the pressure chamber; a supply manifold configured to supply the liquid to the pressure chamber; a return manifold arranged to overlap with the supply manifold as seen from the nozzle surface, and configured to allow the liquid, which is not discharged from the nozzle, to flow therethrough; a pair of elastically deformable portions each of which has a thin plate-shape and which are provided between the supply manifold and the return manifold; a damper space formed between the elastically deformable portions; and a shielding plate configured to separate the damper space into a first damper space on a side of the supply manifold and a second damper space on a side of the return manifold, wherein Young's modulus of the shielding plate is greater than Young's modulus of each of the elastically deformable portions.

According to the above-described configuration, the Young's modulus possessed by the shielding plate is greater than the Young's modulus possessed by each of the elastically deformable portions. Here, as the Young's modulus of a member is greater, the rigidity of the member is higher. Accordingly, even in such a case that one of the elastically deformable portions is greatly deformed due to a pressure wave propagating in the supply manifold or the return manifold, it is possible to suppress, with the shielding plate having a high rigidity, the occurrence of such a situation that any pressure fluctuation (pressure variation) occurring in the damper space between the two elastically deformable portions acts on the other of the elastically deformable portions. As a result, it is possible to prevent the other of the elastically deformable portions from being affected by the deformation of one of the elastically deformable portions.

BRIEF DESCRIPTION OF THE DRAWINGS

FIGS. 3A and 3B are each an enlarged schematic view of a part of the configuration of a liquid discharging head provided on the liquid discharging apparatus as depicted in FIG. 1, wherein FIG. 3A is a view schematically depicting a planar structure of the liquid discharging head, and FIG. 3B is a view schematically depicting a cross-sectional structure of the liquid discharging head.

DESCRIPTION OF THE EMBODIMENTS

An explanation will be given about a liquid discharging apparatus according to an embodiment of the present disclosure, with reference to the drawings. Note that in the following description, an ink discharging apparatus which discharges an ink onto a recording sheet is explained as an example of the liquid discharging apparatus.

<Configuration of Liquid Discharging Apparatus>

Figure 1:
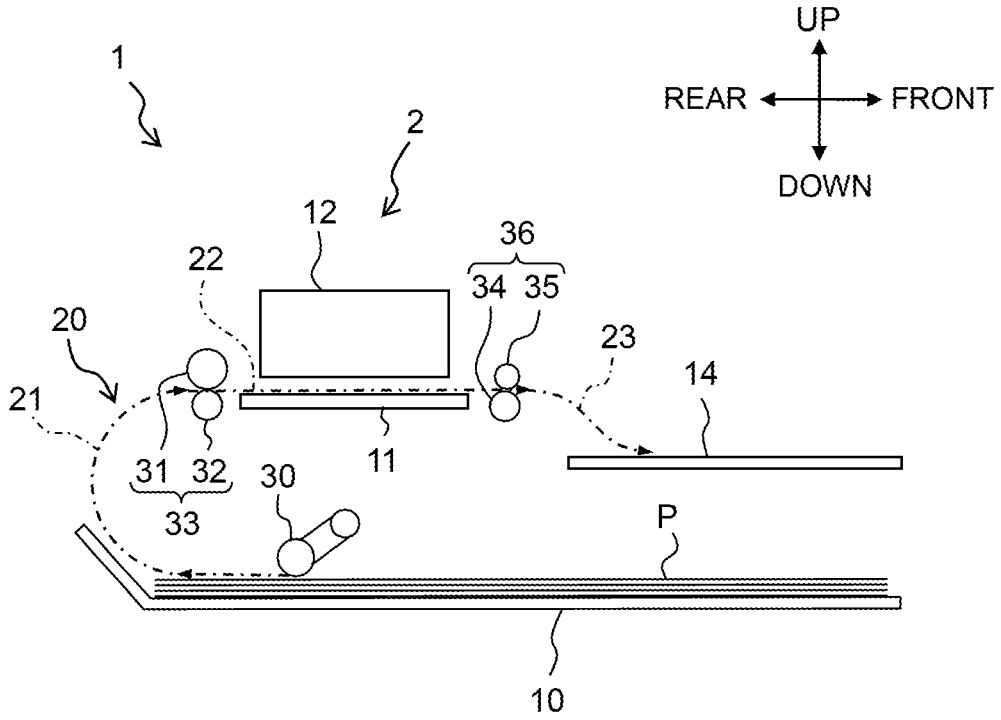
FIG. 1 is a view schematically depicting a configuration of a liquid discharging apparatus according to an embodiment of the present disclosure.

As depicted in FIG. 1, in the liquid discharging apparatus 1, a paper feed tray 10, a platen 11 and a line head 12 are assembled or installed, in this order from the lower side. The paper feed tray 10 accommodates a plurality of pieces of a recording sheet P. The platen 11 is provided at a location above or over the paper feed tray 10. The plate 11 is a flat plate-like member, and supports the recording sheet P which is (being) conveyed from therebelow. The line head 12 is arranged at a location further above the platen 11. Although the specific of the line head 12 will be described later on, the line head 12 is provided with a plurality of liquid discharging heads 13. Further, a paper discharge tray 14 is provided in front of the platen 11; the paper discharge tray 14 receives a recording sheet P for which recording is completed.

A sheet conveying path 20 is provided to extend from a location behind or on the rear side of the paper feed tray 10. The sheet conveying path 20 connects the paper feed tray 10 and the paper discharge tray 14. The sheet conveying path 20 can be divided into three paths which are: a curved path 21, a straight path 22 and an end pass 23. The curved path 21 is curved upward from the paper feed tray 10, and arrives up to a location in the vicinity of the rear side of the platen 11. The straight path 22 extends from a terminal point of the curve path 21 and arrives up to a location in the vicinity of the front side of the platen 11. The end path 23 extends from a terminal point of the straight path 22 and arrives up to the discharge tray 14.

The liquid discharging apparatus 1 is provided with a feeding roller 30, a conveying roller 31 and a discharging roller 34, as a sheet conveying mechanism which conveys the recording sheet P. The sheet conveying mechanism conveys the recording sheet P in the paper feed tray 10 up to the paper discharge tray 14 along the sheet conveying path 20.

Specifically, the feeding roller 30 is arranged at a location immediately above the paper feed tray 10, and makes contact with the recording sheet P from thereabove. The conveying roller 31 constructs, together with a pinch roller 32, a conveying roller part 33, and is arranged at a location in the vicinity of a downstream end of the curbed path 21. The conveying roller part 33 connects the curved path 21 and the straight path 22 to each other. The discharging roller 34 constructs, together with a spur roller 35, a discharging roller part 36, and is arranged at a location in the vicinity of a downstream end of the straight path 22. The discharging roller part 36 connects the straight path 22 and the end path 23 to each other.

Here, the recording sheet P is supplied by the feeding roller 30 to the conveying roller part 33 via the curved path 21. Further, the recording sheet P is fed by the conveying roller part 33 from the straight path 22 to the discharging roller part 36. In the inside of the straight path 22, an ink is discharged from the liquid discharging head 13 with respect to the recording sheet P on the platen 11. An image is recorded on the recording sheet P. The recording sheet P for which the recording is completed is conveyed by the discharging roller part 36 up to the paper discharge tray 14.

Figure 2:
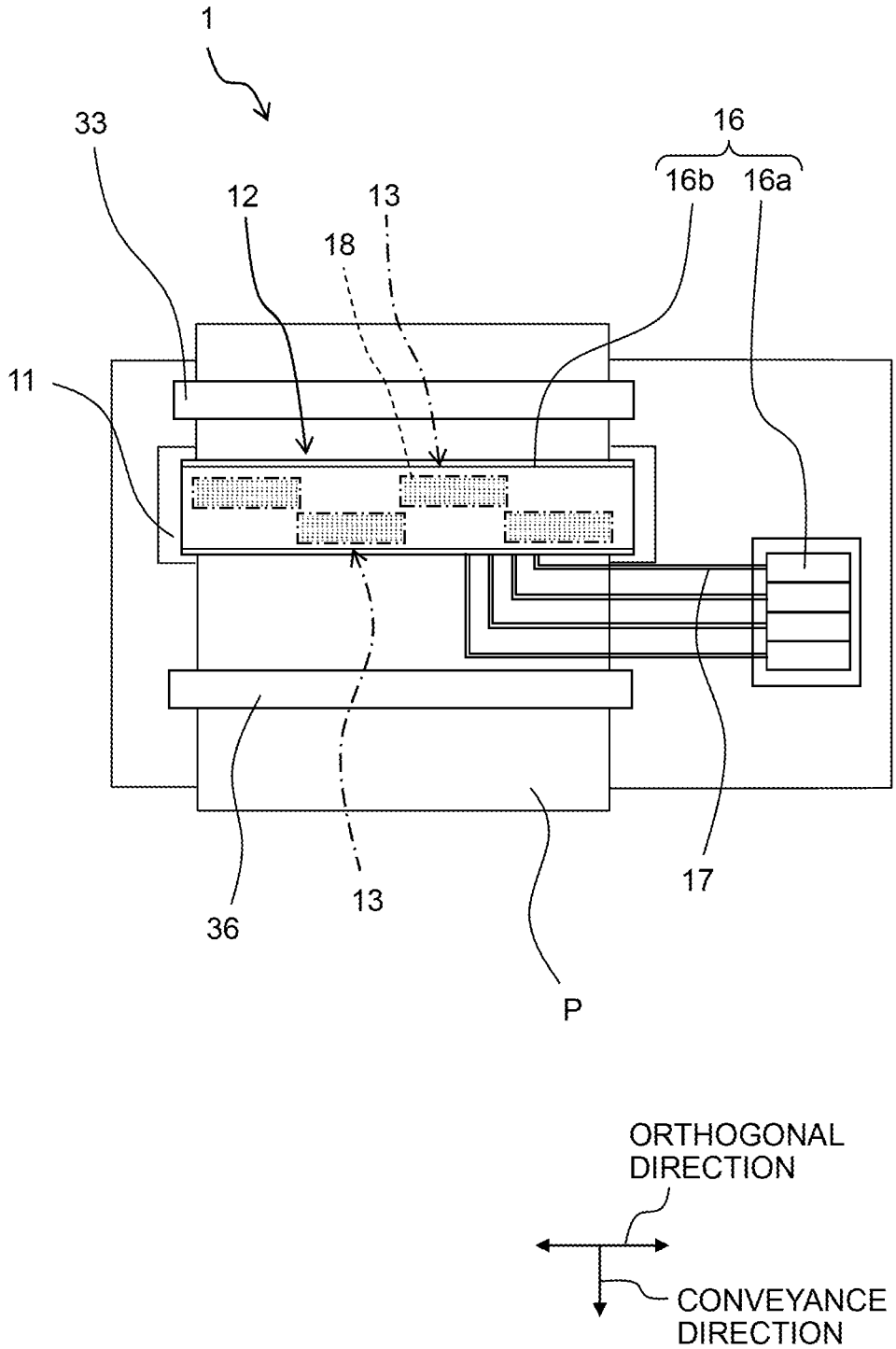
FIG. 2 is a plan view schematically depicting the configuration of the liquid discharging apparatus according to the embodiment of the present disclosure, as seen from thereabove.

FIG. 2 is a plan view schematically depicting the configuration of the liquid discharging apparatus 1 according to the embodiment of the present disclosure, as seen from thereabove. As depicted in FIG. 2, a lower surface of the line head 12 faces or is opposite to the recording sheet P, and has a length which is not less than a length, of the recording sheet P, in a direction orthogonal (orthogonal direction) to a direction in which the recording sheet P is conveyed (conveyance direction). The lower surface of the line head 2 is a nozzle surface in which a plurality of nozzle discharge ports 18 of a plurality of individual channels 100, respectively, (see FIGS. 3A and 3B which will be described later on) are provided.

A tank 16 is connected to each of the nozzle discharge ports 18. The tank 16 has a sub tank 16*b* arranged on the line head 12 and a storing tank 16*a* connected to the sub tank 16*b* with a tube 17. The liquid is stored in the sub tank 16*b* and in the storing tank 16*a*. The tank 16 is provided in a number according to a number of the color of the liquid discharged from the nozzle discharge ports 18*a*; for example, four tanks 16 are provided with respect to liquids of four colors (black, yellow, cyan and magenta), respectively. With this, the line head 12 discharges a plurality of kinds of liquids.

In such a manner, the line head 12 is fixed without moving, and discharges the liquids from the plurality of nozzle discharge ports 18. Together with the discharge of the liquids, the conveying mechanism conveys the recording sheet P in the conveyance direction. With this, an image is recorded on the recording sheet P.

Note that although the explanation has been given about the case that the liquid discharging head 13 is the line head, it is allowable that the liquid discharging head 13 is a serial head, rather than being the line head.

<Configuration of Liquid Discharging Head>

Figure 3A:
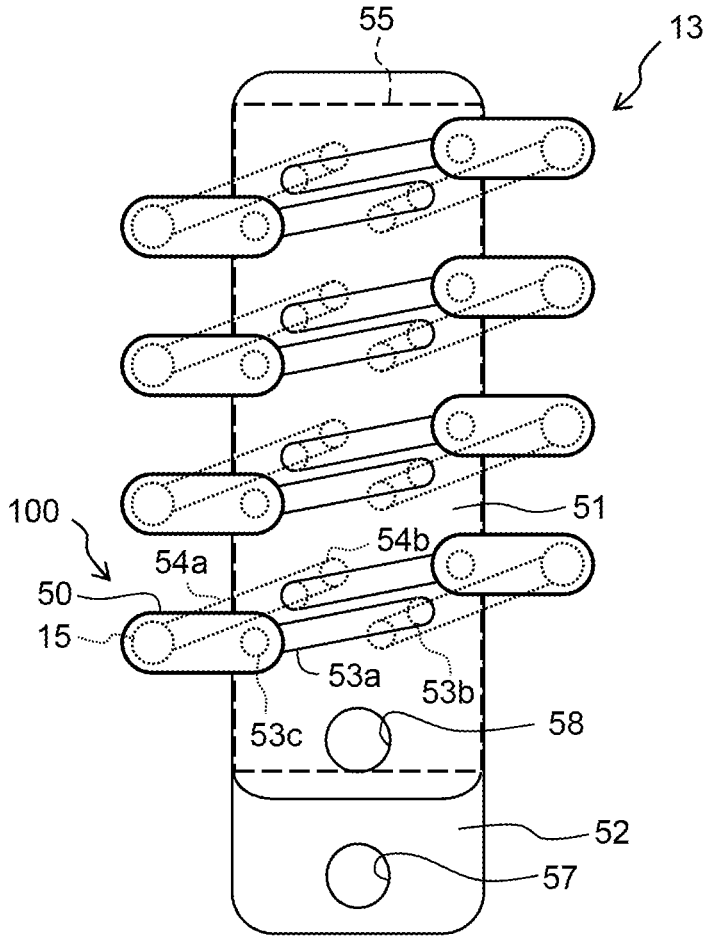
Figure 3B:
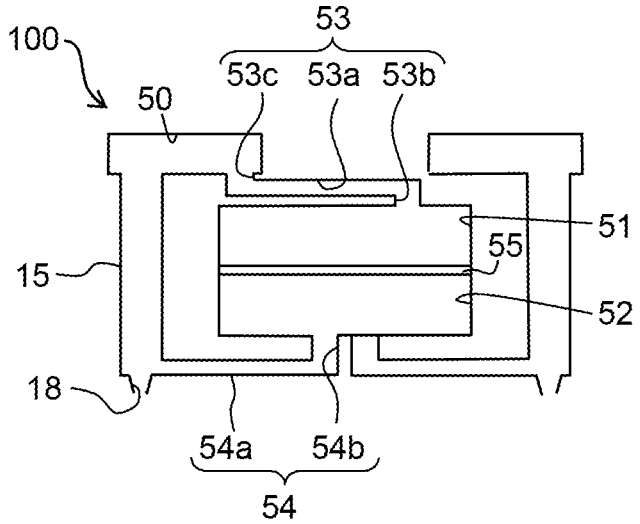

An explanation will be given about the configuration of the liquid discharging head 13, with reference to FIGS. 3A, 3B and 4. In FIGS. 3A and 3B, for the sake of convenience of explanation, the illustration of a piezoelectric plate 60 (to be described later on) which is arranged at a location above a pressure chamber 50 (to be described later on) is omitted.

As depicted in FIG. 3A, the liquid discharging head 13 is provided with a plurality of individual channels 100 which are arranged side by side in one direction. Further, the liquid supplied from the tank 16 is supplied to the inside of a supply manifold 51 via a supply port 58. The liquid supplied to the supply manifold 51 flows through the supply manifold 51 mainly in the one direction and is supplied to each of the plurality of individual channels 100.

Each of the plurality of individual channels 100 has a pressure chamber 50, a descender 15 which communicates with the pressure chamber 50, and a nozzle discharge port 18 which communicates with the descender 15 and via which a liquid droplet of the liquid is discharged. In a case that a side on which the nozzle discharge port 18 is provided is defined as a "downward direction", and an opposite side to the downward direction is defined as an "upward direction", the pressure chamber 50 is arranged at a location upward of the descender 15. As depicted in FIG. 4, a piezoelectric plate 60 (piezoelectric body) is arranged on the upper surface of the pressure chamber 50, and applies pressure to the liquid inside the pressure chamber 50. Namely, in a case that voltage is applied to the piezoelectric plate 60, the piezoelectric plate 60 is deformed to thereby apply pressure to the liquid. With this, it is possible to cause the liquid droplet to be discharged from the nozzle discharge port 18.

Each of the plurality of individual channels 100 is provided with a liquid supply path 53; the supply manifold 51 and the pressure chamber 50 of each of the plurality of individual channels 100 are connected via the liquid supply path 53. The inside of the supply manifold 51 is maintained at the positive pressure so as to feed the liquid to the pressure chamber 50.

Further, in order to cause the liquid, which is not discharged from the nozzle discharge port 18, to flow or circulate, the liquid discharging head 13 is provided with a return manifold 52 which temporarily stores the liquid, and a discharge port 57 which is a discharge port for returning the liquid to the tank 16. The discharge port 57 is arranged in the return manifold 52 at a location thereof which is not overlapped with the supply port 58 as seen from the nozzle surface, as depicted in FIG. 3A. In FIG. 3A, the supply manifold 51 and the return manifold 52 are arranged such that the return manifold 52 is projected more than the supply manifold 51 in the extending direction thereof, and the discharge port 57 and the supply port 58 are arranged at positions, respectively, which are shifted in the extending direction. Each of the plurality of individual channels 100 is provided with a liquid return path 54; the nozzle discharge port 18 of each of the plurality of individual channels 100 and the return manifold 52 are connected via the liquid return path 54. The inside of the return manifold 54 is maintained at the negative pressure so as to draw the liquid, which is not discharged from the nozzle discharge port 18, into the inside of the return manifold 52.

The liquid supply path 53 is provided with a supply throttle part 53*a* extending from the supply manifold 51 toward the pressure chamber 50, a supply throttle inflow port 53*b* provided on one end of the supply throttle part 53*a*, and a supply throttle discharge port 53*c* provided on the other end of the supply throttle part 53*a*. The liquid supply path 53 is joined or linked to the supply manifold 51 by the supply throttle inflow port 53*b*, and is joined or linked to the pressure chamber 50 by the supply throttle discharge port 53*c*. Further, the supply throttle part 53*a* has a channel diameter which is smaller than those of the supply throttle inflow port 53*b* and the supply throttle discharge port 53*c*. In such a manner, since the supply throttle part 53*a* of which channel diameter is small is provided between the pressure chamber 50 and the supply manifold 51, it is possible to suppress the occurrence of such a situation that the liquid to which the pressure is applied due to the deformation of the piezoelectric plate 60 is pushed out of the pressure chamber 50 and flows reversely back toward the supply manifold 51.

The liquid return path 54 is provided with a return throttle part 54*a* which extends from the nozzle discharge port 18 toward the return manifold 52, and which has one end joined or linked to the nozzle discharge port 18 and the descender 15, and a return throttle discharge port 54*b* which is provided on the other end of the return throttle part 54*a*. The liquid return path 54 is joined to the return manifold 52 by the return throttle discharge port 54*b*. Further, the return throttle part 54*a* has a channel diameter smaller than that of the return throttle discharge port 54*b*. In such a manner, since the return throttle part 54*a* of which channel diameter is small is provided between the nozzle discharge port 18 and the return manifold 52, it is possible to suppress the occurrence of such a situation that the liquid which is pushed from the pressure chamber 50 due to the deformation of the piezoelectric plate 60 flows to the return manifold 52 via the liquid return channel 54 and that a liquid droplet amount of the liquid droplet discharged from the nozzle discharge port 18 becomes small.

As described above, each of the plurality of individual channels 100 is connected to the supply manifold 51 via the liquid supply path 53, and each of the plurality of individual channels 100 is also connected to the return manifold 52 via the liquid return path 54.

Further, the supply manifold 51 and the return manifold 52 are arranged such that the supply manifold 51 and the return manifold 52 overlap with each other as seen from the nozzle surface in which the nozzle discharge ports 18 are formed. Furthermore, a damper part 55 is provided between the supply manifold 51 and the return manifold 52. By the damper part 55, it is possible to suppress the influence of any residual vibration propagated from the pressure chamber 50 to the supply manifold 51 via the liquid supply path 53, and to suppress the influence of any residual vibration propagated to the return manifold 52 via the liquid return path 54.

Namely, the damper part 55 has a pair of a first elastically deformable portion 76*a*1 (see FIG. 4) and a second elastically deformable portions 78*a*1 (see FIG. 4) each of which has a shape of a thin plate and which are arranged between the supply manifold 51 and the return manifolds 52, and a damper space 56 defined between the pair of first elastically deformable portion 76*a*1 and second elastically deformable portion 78*a*1. Further, the damper space 56 is comparted or divided, by a shielding plate 77 (see FIG. 4) which is arranged between the first elastically deformable portion 76*a*1 and the second elastically deformable portion 78*a*1, into a first damper space 56*a* (see FIG. 4) on the side of the supply manifold 51 and a second damper space 56*b* (see FIG. 4) on the side of the return manifold 52.

Figure 5:
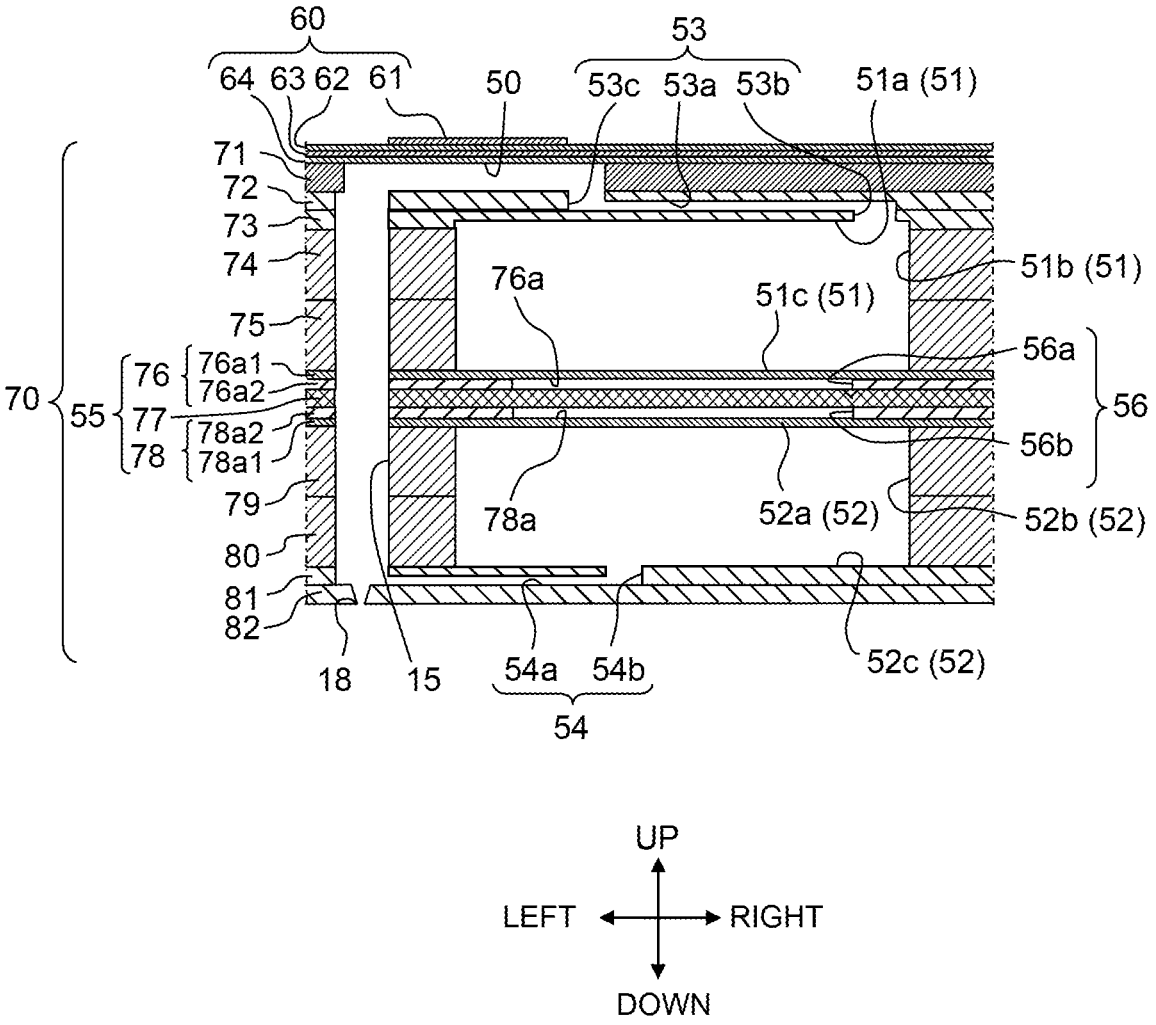
FIG. 5 is a cross-sectional view depicting an example of a specific configuration of the individual channel provided on the liquid discharging head as depicted in FIGS. 3A and 3B.

Here, in the liquid discharging head 13 according to the embodiment of the present disclosure, materials constructing the first elastically deformable portion 76*a*1, the second elastically deformable portion 78*a*1 and the shielding plate 77 are selected appropriately so as to satisfy such a relationship that the Young's modulus possessed by the shielding plate 77 is greater than the Young's modulus possessed by each of the first elastically deformable portion 76*a*1 and the second elastically deformable portion 78*a*1. For example, in a case of forming the damper part 55 of the liquid discharging head 13 by performing the half etching on three plates, it is allowable to construct the shielding plate 77 from stainless steel (for example, SUS410 or SUS430), and to construct each of the first elastically deformable portion 76*a*1 and the second elastically deformable portion 78*a*1 from stainless steel (such as SUS304) of which Young's modulus is smaller than that of the stainless steel constructing the shielding plate 77. Further, it is also allowable to form the damper part 55 of the liquid discharging head 13 by stacking a plurality of (for example, five) plates, as depicted in FIG. 5. FIG. 5 is a cross-sectional view depicting an example of the specific configuration of each of the plurality of individual channels 100 provided on the liquid discharging head 13 depicted in FIGS. 3A and 3B. Note that FIG. 5 depicts an example of the cross-sectional structure, taken along the cross section of an arbitrary individual channel 100 which is included in the plurality of individual channels 100 and which is provided on a nozzle row on the left side in the liquid discharging head 13 as depicted in FIG. 3A.

As depicted in FIG. 5, the damper part 55 is constructed by stacking, in the following order from the upper side, a plate constructing the first elastically deformable portion 76*a*1, a first elastically deformable portion-supporting plate 76*a*2, the shielding plate 77, a second elastically deformable portion-supporting plate 78*a*2, and a plate constructing the second elastically deformable portion 78*a*1. The first elastically deformable portion-supporting plate 76*a*2 arranged between the first elastically deformable portion 76*a*1 and the shielding plate 77 has a through hole, and defines the first damper space 56*a* with the circumferential surface of the through hole and the first elastically deformable portion 76*a*1. Similarly, the second elastically deformable portion-supporting plate 78*a*2 arranged between the second elastically deformable portion 78*a*1 and the shielding plate 77 has a through hole, and defines the second damper space 56*b* with the circumferential surface of the through hole and the second elastically deformable portion 78*a*1. In other words, a sixth plate 76 is constructed of two plates which are the plate constructing the first elastically deformable portion 76*a*1 and the first elastically deformable portion-supporting plate 76*a*2, and a seventh plate 78 is constructed of two plates which are the plate constructing the second elastically deformable portion 78*a*1 and the second elastically deformable portion-supporting plate 78*a*2.

In a case that the damper part 55 is constructed of the five plates in such a manner, it is allowable to construct the shielding plate 77 from stainless steel (for example, SUS430), and to construct the first elastically deformable portion 76*a*1 and the second elastically deformable portion 78*a*1 from a resin, for example, such as polyimide, etc., of which Young's modulus is smaller than that of the stainless steel constructing the shielding plate 77. Further, in the case of this configuration, it is allowable to construct the first elastically deformable portion-supporting plate 76*a*2 and the second elastically deformable portion-supporting plate 78*a*2 of stainless steel similar to the shielding plate 77.

Namely, as the stainless steel constructing the shielding plate 77, it is allowable to use, for example, austenitic stainless steel, martensitic stainless steel, ferritic stainless steel, etc., of which Young's modulus is in a range of 150 GPa to 250 GPa. On the other hand, it is allowable to use polyimide, of which Young's modulus is in a range of 2 GPa to 10 GPa, as the polyimide constructing the first elastically deformable portion 76*a*1 and the second elastically deformable portion 78*a*1. In a case that the Young's modulus of the polyimide constructing the first elastically deformable portion 76*a*1 and the second elastically deformable portion 78*a*1 is in the range of 2 GPa to 10 GPa, the Young's modulus of the stainless steel constructing the shielding plate 77 is in the range of 150 GPa to 250 GPa. Thus, this satisfies the relationship that the Young's modulus possessed by the shielding plate 77 is made to be greater than the Young's modulus possessed by each of the first elastically deformable portion 76*a*1 and the second elastically deformable portion 78*a*1. Further, in a case that the shielding plate 77 and the first and second elastically deformable portions 76*a*1 and 78*a*1 satisfy the above-described relationship, the rigidity of the shielding plate 77 becomes higher than the rigidity of each of the first and second elastically deformable portions 76*a*1 and 78*a*1. Accordingly, even in such a case that one of the first and second elastically deformable portions 76*a*1 and 78*a*1 is greatly deformed due to the influence of the pressure wave propagating through the supply manifold 51 or the return manifold 52, the shielding plate 77 having the high rigidity is capable of suppressing the occurrence of such a situation that any pressure fluctuation (pressure variation) occurring in the damper space between the first and second elastically deformable portions 76*a*1 and 78*a*1 acts on the other of the first and second elastically deformable portions 76*a*1 and 78*a*1, to thereby prevent the other of the first and second elastically deformable portions 76*a*1 and 78*a*1 from being affected thereby.

Note that the shielding plate 77 is not limited to or restricted by being constructed of the stainless steel as described above; the shielding plate 77 may be constructed, for example, of silicone. On the other hand, the first elastically deformable portion 76*a*1 and the second elastically deformable portion 78*a*1 may be constructed of a resin-based material such as PET (polyethylene terephthalate) or PP (polypropylene), etc.

It is allowable to form the respective parts, components, etc., provided on the liquid discharging head 13 as described above by performing a processing such as the etching (half etching) or cutting, etc., for each of the plurality of plates, and by stacking these plates. Alternatively, it is allowable to form the respective parts, components, etc., provided on the liquid discharging head 13 as described above by stacking a plurality of plates each of which is molded to have a predetermined shape. In the following, an explanation will be given about an example of the construction and assembling of the liquid discharging head 13.

Figure 4:
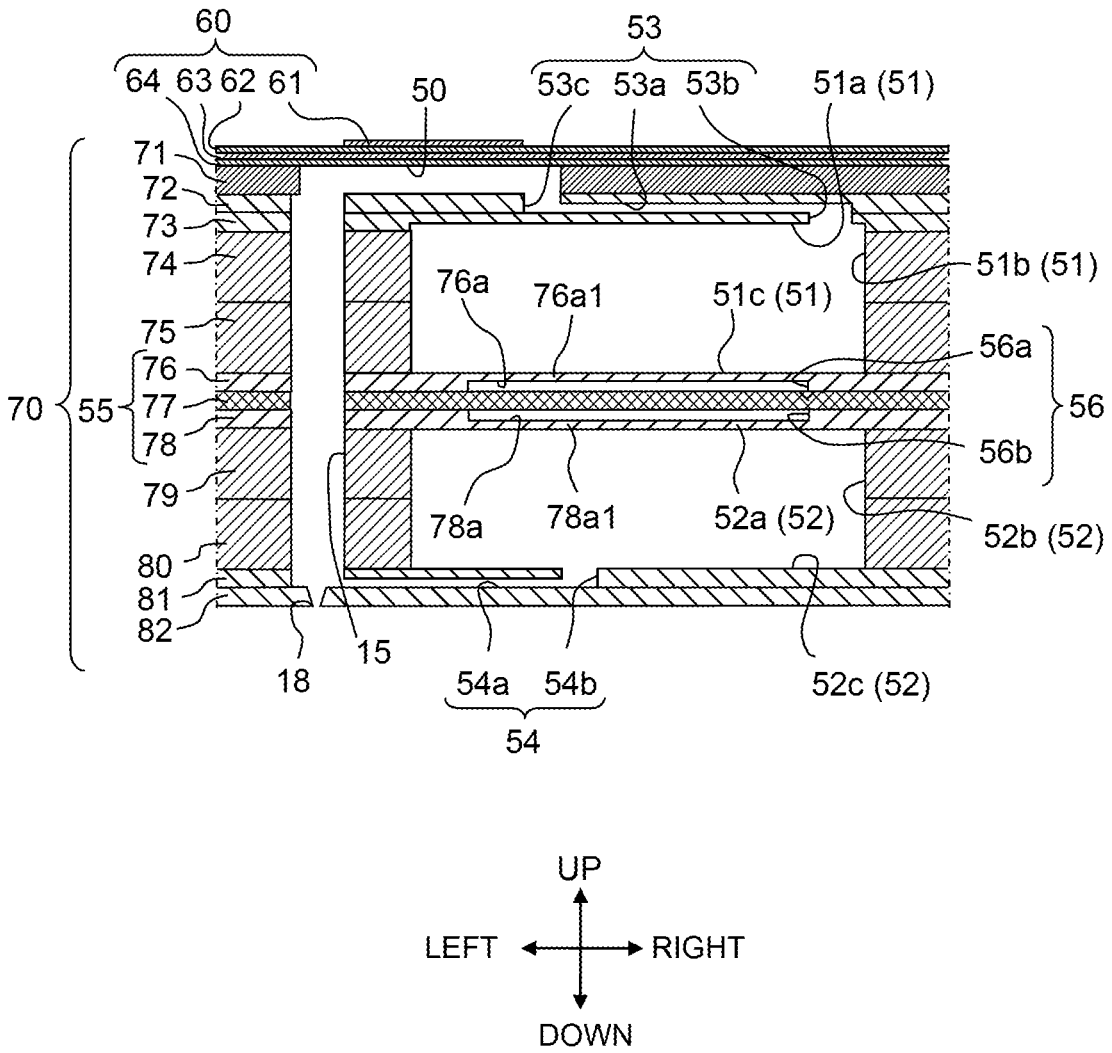
FIG. 4 is a cross-sectional view depicting an example of a specific configuration of an individual channel provided on the liquid discharging head as depicted in FIGS. 3A and 3B.

As depicted in FIG. 4, the liquid discharging head 13 is provided with a channel unit 70 constructed of a plurality of stacked plates, and a piezoelectric plate 60 which is overlaid on and adhered to the upper surface of the channel unit 70 and which functions as an actuator.

As depicted in FIG. 4, the piezoelectric plate 60 is arranged on the upper surface of a first plate 71 at a position at which the piezoelectric plate 60 overlap with the pressure chamber 50 of each of the plurality of individual channels 100 as seen from the nozzle surface. The piezoelectric plate 60 has such a configuration that an individual electrode 61, a piezoelectric layer 62, a common electrode 63 and a vibration plate 64 are stacked in this order from the upper side. The respective layers except for the individual electrode 61 are arranged commonly on one piece of the nozzle row, and the individual electrode 61 is provided as individual electrodes 60 each of which is arranged corresponding individually to the pressure chamber 50 of one of the plurality of individual channels 100. The piezoelectric layer 62 is formed, for example, of a piezoelectric material including lead zirconate titanate (PZT).

The common electrode 63 is maintained at the ground potential. The individual electrodes 61 are connected to a non-illustrated driver IC provided on the liquid discharging apparatus 1. The potential of each of the individual electrodes 61 is individually set to the ground potential or a predetermined driving potential, by the driver IC. A part, of the piezoelectric layer 62, which is sandwiched between the common electrode 63 and each of the individual electrodes 61 functions as an active part which is polarized in a stacking direction (up-down direction) in a case that each of the individual electrodes 61 is energized.

In the piezoelectric plate 60, in a case that any liquid droplet is not discharged from the nozzle discharge port 18 (in a stand-by state), all the individual electrodes 61 are maintained at the ground potential, similarly to the common electrode 63. Further, in the piezoelectric plate 60, in a case that a liquid droplet is to be discharged from a specific nozzle discharge port 18, the potential of an individual electrode 61, among the individual electrodes 61, corresponding to a certain pressure chamber 50 communicating with the specific nozzle discharge port 18 is switched, by a non-illustrated controller, to the predetermined driving potential. With this, the piezoelectric plate 60 is deformed so as to project toward the certain pressure chamber 50. As a result, the volume of the certain pressure chamber 50 is reduced, which in turn raises the pressure (positive pressure) of the liquid in the inside of the certain pressure chamber 50, thereby discharging the liquid droplet from the specific nozzle discharge port 18. After the liquid droplet has been discharged, the potential of the individual electrode 61 is returned to the ground potential. With this, the piezoelectric plate 60 returns to the state before the deformation.

Further, the controller deforms a part, of the piezoelectric plate 60, corresponding to a nozzle discharge port 18 from which the liquid droplet is not discharged, in a retracted or withdrawn state with respect to the liquid. The piezoelectric plate 60 in this situation is deformed so as to be recessed with respect to the side of another pressure chamber 50 corresponding to this part of the piezoelectric plate 60. As a result, the volume of the another pressure chamber 50 is increased, which in turn make the pressure of the liquid inside the another pressure chamber 50 to be a negative pressure. With this, any discharge of the liquid from such a nozzle discharge port 18 for which the discharge of the liquid is not desired or intended, is suppressed. Note that an aspect of the control for the voltage to be applied to the piezoelectric plate 60 in the case of allowing the liquid to be discharged from the nozzle discharge port 18 is publicly known as a variety of control aspects. Accordingly, the aspect of the control applicable to the liquid discharging apparatus 1 according to the present embodiment is not limited to or restricted by that as described above, and any other publicly known aspect of the control may be adopted.

The channel unit 70 is constructed by staking, in the following order from the upper side, first plate 71 to eleventh plate 82, and liquid droplets are discharged downward from the nozzle discharge ports 18 provided on the lower surface of the channel unit 70.

Namely, a through hole extending in the stacking direction is formed in the first plate 71, and each of the pressure chambers 50 is constructed of this through hole and the piezoelectric plate 60 arranged on the upper surface of the first plate 71 and the second plate 72 arranged on the lower surface of the first plate 71.

Further, a recessed area is formed in the lower surface of the second plate 72 so that the recessed area extends from a position of a right end part of each of the pressure chambers 50 in a rightward direction. Furthermore, a through hole extending in the stacking direction so as to communicate with each of the pressure chambers 50 is formed in the second plate 72 at one end of the recessed area (the position of the right end part of each of the pressure chambers 50). Moreover, the through hole of the second plate 72 constructs the supply throttle discharge port 53*c* of the liquid supply path 53, and the recessed area of the second plate 72 and the third plate 73 arranged on a location below the second plate 72 construct the supply throttle part 53*a*.

Further, a through hole extending in the stacking direction and communicating with the supply manifold 51 is formed in the third plate 73 at a position which overlaps with a position of the other end part of the recessed area formed in the second plate 72. Furthermore, the through hole formed in the third plate 73 constructs the supply throttle inflow port 53*b* of the liquid supply path 53.

Moreover, a recessed area defining an upper inner wall surface 51*a* of the supply manifold 51 is formed in the lower surface of the third plate 73. Further, through holes extending in the stacking direction are formed in the fourth plate 74 and the fifth plate 75, respectively, and circumferential surfaces of these through holes define an inner side wall surface 51*b* of the supply manifold 51. Furthermore, the upper surface of the sixth plate 76 defines a lower inner wall surface 51*c* (first inner wall surface) of the supply manifold 51. By stacking the third plate 73 to the sixth plate 76, it is possible to construct the supply manifold 51.

Further, the sixth plate 76, the shielding plate 77 arranged at a position below the sixth plate 76 and the seventh plate 78 arranged at a position below the shielding plate 77 define the damper part 55. The details of the damper part 55 will be explained later on. Note that the sixth plate 76 is referred also to as a "supply manifold-side plate", in some cases. Further, the seventh plate 78 is referred also to as a "return manifold-side plate", in some cases.

The return manifold 52 constructed of the seventh plate 78 to the tenth plate 81 is arranged at a position below the damper part 55. Namely, the lower surface of the seventh plate 78 defines an upper inner wall surface 52*a* (second inner wall surface) of the return manifold 52. Through holes extending in the stacking direction are formed in the eighth plate 79 and the ninth plate 80 which are arranged at a position below the seventh plate 78, and circumferential surfaces of these through holes define a side inner wall surface 52*b* of the return manifold 52. Further, the upper surface of the tenth plate 81 defines an inner wall surface 52*c* of the return manifold 52.

Furthermore, through holes extending in the stacking direction are formed in the second plate 72 to the tenth plate 81, respectively, at a position of an end part (position of a left end part) of each of the pressure chambers 50 which is on the opposite side of the end part, of each of the pressure chambers 50, communicating with the liquid supply path 53, so that the through holes communicate with each of the pressure chambers 50. Moreover, a tapered aperture of which diameter is gradually reduced toward the downward direction is formed in the eleventh plate 81. The through holes formed in the second plate 72 to the tenth plate 81, respectively, form the descender 15, and the tapered aperture formed in the eleventh plate 82 forms the nozzle discharge port 18.

Further, the tenth plate 81 has: a through hole forming a part of the descender 15; and a recessed area communicating with the nozzle discharge port 18 formed in the eleventh plate 82 and extending rightward. The return throttle part 54*a* is formed between this recessed area and the eleventh plate 82. Furthermore, a through hole extending in the stacking direction so as to communicate with the return manifold 52 is formed in an end part, of the recessed area formed in the tenth plate 81, on a side opposite to the side at which the descender 15 is arranged; and this through hole forms a return throttle discharge port 54*b*.

<Damper Part>

As depicted in FIG. 4, the damper part 55 is constructed of the sixth plate 76, the shielding plate 77 and the seventh plate 78. The sixth plate 76 has a first recessed area 76*a* which is recessed from a side of the shielding plate 77 toward the lower inner wall surface 51*c* of the supply manifold 51. It is possible to form the first recessed area 76*a* by, for example, performing the half etching for the lower surface of the sixth plate 76. Further, it is possible to form the first damper space 56*a*, which is a space surrounded by the first recessed area 76*a* and the shielding plate 77, by stacking the sixth plate 76 and the shielding plate 77 positioned below the sixth plate 76. Furthermore, in the sixth plate 76, a thin plate-portion of the first recessed area 76*a* is made to be the first elastically deformable portion 76*a*1; it is possible to cause the first elastically deformable portion 76*a*1 and the first damper space 56*a* to function as a damper which suppresses the influence of the pressure wave propagated in the inside of the supply manifold 51. Namely, in a case that the pressure wave due to any residual vibration propagates in the inside of the supply manifold 51, the first elastically deformable portion 76*a*1 is deformed, thereby making it possible to absorb, by the air inside the first damper space 56*a*, the force due to the pressure wave. Moreover, even in such a case that the pressure applied to the first elastically deformable portion 76*a*1 is large and that the first elastically deformable portion 76*a*1 is deformed to such an extent that the first elastically deformable portion 76*a*1 makes contact with (abuts against) the second elastically deformable portion 78*a*1 which is arranged to form the pair with the first elastically deformable portion 76*a*1, it is possible to suppress this deformation by the shielding plate 77 of which Young's modulus is greater than that of the first elastically deformable portion 76*a*1, and to suppress any contact between the first and second elastically deformable portions 76*a*1 and 78*a*1.

The second plate 78 arranged below the shielding plate 77 has a second recessed area 78*a* which is recessed from the side of the shielding plate 77 toward the upper inner wall surface 52*a* of the return manifold 52. It is possible to form the second recessed area 78*a* by, for example, performing the half etching for the upper surface of the seventh plate 78, in a similar manner as regarding the first recessed area 76*a*. Further, it is possible to form the second damper space 56*b*, which is a space surrounded by the second recessed area 78*a* and the shielding plate 77, by stacking the shielding plate 77 which is positioned above the seventh plate 78 and the seventh plate 78. Further, in the seventh plate 78, a thin plate-portion of the second recessed area 78*a* is made to be the second elastically deformable portion 78*a*1; it is possible to cause the second elastically deformable portion 78*a*1 and the second damper space 56*b* to function as a damper which suppresses the influence of the pressure wave propagated in the inside of the return manifold 52. Namely, in a case that the pressure wave due to any residual vibration propagates in the inside of the return manifold 52, the second elastically deformable portion 78*a*1 is deformed, thereby making it possible to absorb, by the air inside the second damper space 56*b*, the force due to the pressure wave. Moreover, even in such a case that the pressure applied to the second elastically deformable portion 78*a*1 is large and that the second elastically deformable portion 78*a*1 is deformed to such an extent that the second elastically deformable portion 78*a*1 makes contact with (abuts against) the first elastically deformable portion 76*a*1 which is arranged to form the pair with the second elastically deformable portion 78*a*1, it is possible to suppress this deformation by the shielding plate 77 of which Young's modulus is greater than that of the second elastically deformable portion 78*a*1, and to suppress any contact between the second and first elastically deformable portions 78*a*1 and 76*a*1.

As described above, in the liquid discharging head 13 according to the present embodiment, it is possible to form the first recessed area 76*a* in the sixth plate 76 by, for example, performing the half etching therefor. Further, the sixth plate 76 having the first recessed area 76*a* formed therein in such a manner can be used also as the lower inner wall surface 51*c* of the supply manifold 51, the first damper space 56*a* and the first elastically deformable portion 76*a*1. Similarly, it is possible to form the second recessed area 78*a* in the seventh plate 78 by, for example, performing the half etching therefor. Further, the seventh plate 78 having the second recessed area 78*a* formed therein in such a manner can be used also as the upper inner wall surface 52*a* of the return manifold 52, the second damper space 56*b* and the second elastically deformable portion 78*a*1. Accordingly, it is possible to reduce the number of the parts or components, etc., in the liquid discharging head 13.

Further, in the case of forming the first elastically deformable portion 76*a*1 and the second elastically deformable portion 78*a*1 by forming the first recessed area 76*a* and the second recessed area 78*a* in the sixth plate 76 and the seventh plate 78, respectively, by the half etching, it is possible to increase the handling property in the manufacturing process of the damper part 55, since the sixth plate 76 and the seventh plate 78 each have an appropriate thickness. Note, as described above, that the liquid discharging head 13 is configured so that the Young's modulus possessed by the shielding plate 77 is greater than the Young's modulus possessed by each of the first elastically deformable portion 761*a* and the second elastically deformable portion 78*a*1. Accordingly, it is allowable that the material constructing each of the sixth plate 76 and the seventh plate 78 is made, for example, to be a resin material such as polyimide, and that the material constructing the shielding plate 77 is made, for example, to be stainless steel.

Further, the damper space 56 is a space area formed between the first recessed area 76*a* of the sixth plate 76 and the second recessed area 78*a* of the seventh plate 78, and is separated into the first damper space 56*a* and the second damper space 56*b* by the shielding plate 77. In the liquid discharging head 13 related to the present embodiment, the arrangement relationship between the damper space 56 and the supply and return manifolds 51 and 52 is as follows. Namely, in a case that the liquid discharging head 13 is seen from the nozzle surface, in the sixth plate 76, the first elastically deformable portion 76*a*1 of the first recessed area 76*a* is included in an area defining the lower inner wall 51*c* of the supply manifold 51. Further, in the seventh plate 78, the second elastically deformable portion 78*a*1 of the second recessed area 78*a* is included in an area defining the upper inner wall 52*c* of the return manifold 52.

Namely, in the case that the liquid discharging head 13 is seen from the nozzle surface, the range, in the sixth plate 76, in which the supply manifold 51 is formed is greater than the range in which the first damper space 56*a* is formed. Further, the range, in the seventh plate 78, in which the return manifold 52 is formed is greater than the range in which the second damper space 56*b* is formed.

Accordingly, even in such a case that any deviation in the adhesion occurs in a case that the sixth plate 76 and the seventh plate 78 are stacked on each other, it is possible to secure a necessary space area, as the damper space 56, between the supply manifold 51 and the return manifold 52. Thus, it is possible to maintain the damper property of the damper part 55.

Further, as depicted in FIG. 4, it is allowable that, in the liquid discharging head 13, the thickness sizes in the stacking direction (up-down direction) of the sixth plate 76, the shielding plate 77 and the seventh plate 78, respectively, are same as one another. In particular, in a case that the sixth plate 76 and the seventh plate 78 are allowed to have a same size, it is possible to construct the sixth plate 76 and the seventh plate 78 of same plates, thereby making it possible to reduce the cost.

Furthermore, the size in the stacking direction of each of the first damper space 56*a* and the second damper space 56*b* is made to be smaller than the thickness size in the stacking direction of the shielding plate 77. Owing to such a configuration, it is possible to make the thickness of the liquid discharging head 13 as a whole to be small. Therefore, it is possible to make the distance of the descender 15 from the pressure chamber 50 up to the nozzle discharge port 18 to be short. Namely, in the liquid discharging head 13, it is possible to make the acoustic length (AL) to be short, which in turn makes it possible to make the time until the pressure wave heading from the pressure chamber 50 toward the nozzle discharge port 18 is reflected and returns to be short. Thus, the liquid discharging head 13 is capable of realizing the high frequency driving.

Here, in a case that the liquid discharging head 13 is subjected to the high frequency driving, the frequency at which the pressure wave propagates to the supply manifold 51 or the return manifold 52 becomes high, as a result of which the possibility that the first elastically deformable portion 76*a*1 and the second elastically deformable portion 78*a*1 interfere with each other becomes high. In this liquid discharging head 13, however, the shielding plate 77 has a predetermined thickness (the thickness which is greater than each of the first damper space 56*a* and the second damper space 56*b*), and thus it is possible to prevent any influence by this interference.

Further, in the liquid discharging head 13, each of the first damper space 56*a* and the second damper space 56*b* is configured to be a closed space. Accordingly, it is possible to prevent such a situation that a liquid such as the ink, etc., enters into the first damper space 56*a* and the second damper space 56*b*, and that the deformations of the first elastically deformable portion 76*a*1 and the second elastically deformable portion 78*a*1 are inhibited.

As described above, the liquid discharging apparatus 1 according to an aspect of the present disclosure includes: a pressure chamber 50 configured to store liquid and communicating with a nozzle discharge port 18; a piezoelectric plate 60 configured to apply pressure to the liquid inside the pressure chamber 50; a supply manifold 51 configured to supply the liquid to the pressure chamber 50; a return manifold 52 configured to allow the liquid, which is not discharged from the nozzle discharge port 18, to flow therethrough; a pair of a first elastically deformable portion 76*a*1 and a second elastically deformable portion 78*a*1 each of which has a thin plate-shape and which are provided between the supply manifold 51 and the return manifolds 52 arranged so that the supply manifold 51 and the return manifold 52 overlap with each other as seen from a nozzle surface in which the nozzle discharge port 18 is formed; and a shielding plate 77 separating a damper space formed between the pair of first and second elastically deformable portions 76*a*1 and 78*a*1 into a first damper space 56*a* on a side of the supply manifold 51 and a second damper space 56*b* on a side of the return manifold 52. Further, Young's modulus possessed by the shielding plate 77 is greater than Young's modulus possessed by each of the pair of first and second elastically deformable portions 76*a*1 and 78*a*1.

According to the above-described configuration, it is possible to prevent, by the shielding plate 77, the elastic deformation of one of the elastically deformable portions from affecting the other of the elastically deformable portions.

Further, it is allowable that in the liquid discharging apparatus 1 according to the aspect of the present disclosure, in the above-described configuration, the shielding plate 77 is constructed of stainless steel, and the first and second elastically deformable portions 76*a*1 and 78*a*1 are constructed of polyimide.

According to the above-described configuration, since the first and second elastically deformable portions 76*a*1 and 78*a*1 are constructed of polyimide, it is possible to appropriately absorb the pressure wave propagated in the supply manifold 51 or the return manifold 52. Further, since the shielding plate 77 is formed of the stainless steel of which Young's modulus is greater than that of the polyimide and which is harder than the polyimide constructing the first and second elastically deformable portions 76*a*1 and 78*a*1, it is possible to prevent, by the shielding plate 77, the elastic deformation of one of the elastically deformable portions from affecting the other of the elastically deformable portions.

Furthermore, it is allowable that in the liquid discharging apparatus 1 according to the aspect of the present disclosure, in the above-described configuration, the shielding plate 77 is arranged between a sixth plate 76 defining a lower inner wall surface 51*c* of the supply manifold 51 and a seventh plate 78 defining an upper inner wall surface 52*a* of the return manifold 52. Moreover, it is allowable that the sixth plate 76 has a first recessed area 76*a* which is recessed from a side of the shielding plate 77 toward the lower inner wall surface 51*c* to form the first damper space 56*a*. Further, it is allowable that the seventh plate 78 has a second recessed area 78*a* which is recessed from the side of the shielding plate 77 toward the upper inner wall surface 52*a* to form the second damper space 56. Furthermore, it is allowable that, among the pair of elastically deformable portions, the first elastically deformable portion 76*a*1 is a thin plate-portion in the first recessed area 76*a*, and the second elastically deformable portion 78*a*1 is a thin plate-portion in the second recessed area 78*a*.

According to the above-described configuration, it is possible to use the sixth plate 76 having the first recessed area 76*a* also as the lower inner wall surface 51*c* of the supply manifold 51, the first damper space 56*a*, and the first elastically deformable portion 76*a*1. Further, it is possible to use the seventh plate 78 having the second recessed area 78*a* also as the upper inner wall surface 52*a* of the return manifold 52, the second damper space 56*b*, and the second elastically deformable portion 78*a*1. Accordingly, it is possible to reduce the number of the parts or components, etc., in the liquid discharging apparatus 1.

Further, it is allowable that in the liquid discharging apparatus 1 according to the aspect of the present disclosure, in the above-described configuration, the damper space 56 is a space formed between the first recessed area 76*a* and the second recessed area 78*b* of the sixth plate 76 and the seventh plate 78, respectively, which are stacked. Further, as seen from the nozzle surface, the first elastically deformable portion 76*a*1 may be included in an area, in the sixth plate 76, which defines the lower inner wall surface 51*c*; and as seen from the nozzle surface, the second elastically deformable portion 78*a*1 may be included in an area, in the seventh plate 78, which defines the upper inner wall surface 52*a*.

According to the above-descried configuration, the range, in the sixth plate 76, in which the supply manifold 51 is formed is greater than the range, in the sixth plate 76, in which the damper space 56 is formed, as seen from the nozzle surface. Further, the range, in the seventh plate 78, in which the return manifold 52 is formed is greater than the range, in the seventh plate 78, in which the damper space 56 is formed, as seen from the nozzle surface.

Accordingly, even in such a case that any deviation in the adhesion occurs in a case that the sixth plate 76 and the seventh plate 78 are stacked on each other, it is possible to secure a necessary space area, as the damper space 56, between the supply manifold 51 and the return manifold 52. Thus, it is possible to maintain the damper property of the damper part 55, even in the case that any deviation in the adhesion occurs.

Further, it is allowable that in the liquid discharging apparatus 1 according to the aspect of the present disclosure, in the above-described configuration, the size in the stacking direction (up-down direction) of each of the first damper space 56*a* and the second damper space 56*b* is smaller than a thickness size of the shielding plate 77 in the stacking direction.

According to the above-described configuration, the size in the stacking direction of each of the first damper space 56*a* and the second damper space 56*b* is made to be smaller than the thickness size in the stacking direction of the shielding plate 77. Owing to such a configuration, it is possible to make the thickness of the liquid discharging apparatus 1 as a whole to be small. Therefore, it is possible to make the distance of the descender 15 from the pressure chamber 50 up to the nozzle discharge port 18 to be short. In other words, in the liquid discharging apparatus 1, it is possible to make the acoustic length (AL) to be short, which in turn makes it possible to make the time until the pressure wave heading from the pressure chamber 50 toward the nozzle discharge port 18 is reflected and returns to the pressure chamber 50 be short. Thus, the liquid discharging apparatus 1 is capable of realizing the high frequency driving.

Note that in a case that the liquid discharging apparatus 1 is subjected to the high frequency driving, the frequency at which the pressure wave propagates in the inside of the supply manifold 51 or the return manifold 52 becomes high, as a result of which the possibility that the first elastically deformable portion 76*a*1 and the second elastically deformable portion 78*a*1 interfere with each other becomes high. In this liquid discharging apparatus 1, however, the shielding plate 77 has a predetermined thickness, and thus it is possible to prevent any influence by this interference.

It is allowable that in the liquid discharging apparatus 1 according to the aspect of the present disclosure, in the above-described configuration, the damper space 56 is a closed space.

Accordingly to the above-described configuration, since the damper space 56 is the closed space, it is possible to prevent such a situation that a liquid such as the ink, etc., enters into the first damper space 56*a* and that the deformations of the first elastically deformable portion 76*a*1 and the second elastically deformable portion 78*a*1 are inhibited.

The present disclosure is applicable, for example, to an ink-jet printer, etc., which is configured to discharge a liquid droplet from a nozzle discharge port toward a paper sheet.

What is claimed is:

1. A liquid discharging apparatus comprising:

a nozzle surface in which a nozzle is formed;

a pressure chamber communicating with the nozzle and configured to store liquid;

a piezoelectric body configured to apply pressure to the liquid inside the pressure chamber;

a supply manifold configured to supply the liquid to the pressure chamber;

a return manifold arranged to overlap with the supply manifold as seen from the nozzle surface, and configured to allow the liquid, which is not discharged from the nozzle, to flow therethrough;

a pair of elastically deformable portions each of which has a thin plate-shape and which are provided between the supply manifold and the return manifold;

a damper space formed between the elastically deformable portions; and a shielding plate configured to separate the damper space into a first damper space on a side of the supply manifold and a second damper space on a side of the return manifold, wherein Young's modulus of the shielding plate is greater than Young's modulus of each of the elastically deformable portions.

2. The liquid discharging apparatus according to claim 1, wherein the shielding plate is constructed of stainless steel, and the elastically deformable portions are constructed of polyimide.

3. The liquid discharging apparatus according to claim 1, further comprising: a supply manifold-side plate defining a first inner wall surface of the supply manifold; and a return manifold-side plate defining a second inner wall surface of the return manifold, wherein the shielding plate is arranged between the supply manifold-side plate and the return manifold-side plate, the supply manifold-side plate has a first recessed area which is recessed from a side of the shielding plate toward the first inner wall surface to form the first damper space, the return manifold-side plate has a second recessed area which is recessed from the side of the shielding plate toward the second inner wall surface to form the second damper space, and the elastically deformable portions include a first elastically deformable portion which is a thin plate-portion in the first recessed area, and a second elastically deformable portion which is a thin plate-portion in the second recessed area.

4. The liquid discharging apparatus according to claim 3, wherein the damper space is a space formed between the first recessed area and the second recessed area, as seen from the nozzle surface, the first elastically deformable portion is included in an area, of the supply manifold-side plate, which defines the first inner wall surface, and as seen from the nozzle surface, the second elastically deformable portion is included in an area, of the return manifold-side plate, which defines the second inner wall surface.

5. The liquid discharging apparatus according to claim 4, wherein the supply manifold side-plate and the return manifold-side plate are stacked in a predetermined direction, with the shielding plate being sandwiched therebetween, and a size in the predetermined direction of each of the first damper space and the second damper space is smaller than a thickness of the shielding plate in the predetermined direction.

6. The liquid discharging apparatus according to claim 1, wherein the damper space is a closed space.

* * * * *